United States Patent [19]

Teague, Jr. et al.

[11] 4,229,150

[45] Oct. 21, 1980

[54] ANTI-ROTATION ARRANGEMENT FOR NUTATING FLUID DEVICE

[76] Inventors: Walter D. Teague, Jr., Tweed Blvd., Nyack, N.Y. 10960; Arthur T. Sempliner, 37-04 Van Nostrand Pl., Douglaston, N.Y. 11363

[21] Appl. No.: 911,803

[22] Filed: Jun. 2, 1978

[51] Int. Cl.[3] ..... F01C 1/00; F03C 2/00

[52] U.S. Cl. ..... 418/50; 418/53

[58] Field of Search ..... 418/49-53; 73/258

[56] References Cited

U.S. PATENT DOCUMENTS

| | | | |
|---|---|---|---|
| 1,100,635 | 6/1914 | Urkewitz | 418/53 |
| 1,875,160 | 8/1932 | Ryder | 418/53 |

FOREIGN PATENT DOCUMENTS

| | | | |
|---|---|---|---|
| 99176 | 2/1925 | Austria | 73/258 |
| 1044838 | 11/1958 | Fed. Rep. of Germany | 418/53 |
| 402278 | 8/1909 | France | 73/258 |
| 174418 | 5/1935 | Switzerland | 418/153 |

*Primary Examiner*—John J. Vrablik

*Attorney, Agent, or Firm*—Mandeville and Schweitzer

[57] ABSTRACT

In a fluid driven, nutating action apparatus, comprising a motor housing with a wobble plate mounted therein for universal tilting movement and movable by the driving fluid through progressively changing tilt angles for a nutating action cycle, a new and improved means for preventing rotation of the wobble plate is disclosed. In accordance with known construction of fluid driven, nutating action motors, a dividing wall is arranged in the motor housing and extends from the top wall of the housing to the bottom wall thereof. The wobble plate includes a slot arranged to straddle the dividing wall. In accordance with the present invention, at least a portion of the edges of the slot are placed in a close bearing relation to the dividing wall. The dividing wall is arranged and configured whereby the close bearing relationship between the slot and the dividing wall is maintained for the entire nutating action cycle of the motor, providing a superior working action of the wobble plate.

6 Claims, 7 Drawing Figures

FIG. 1
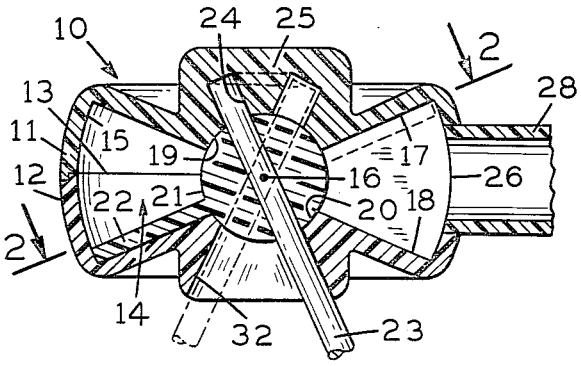
FIG. 2
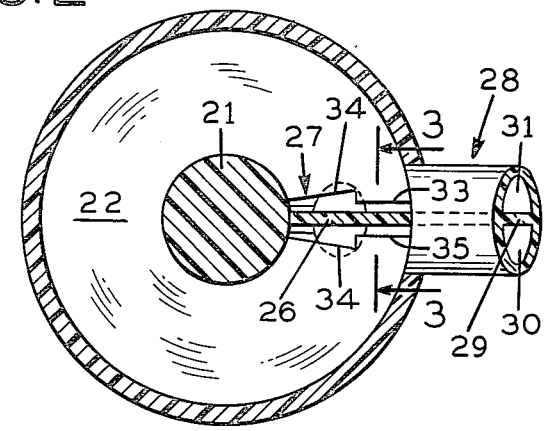
FIG. 4
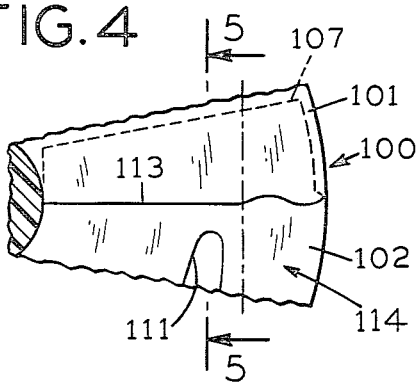
FIG. 3
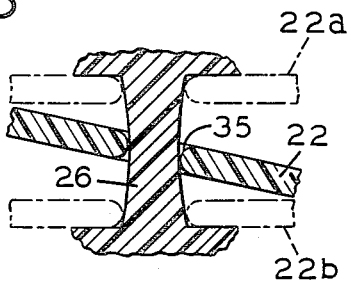
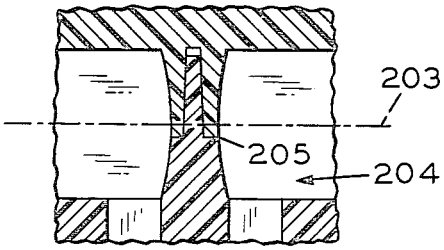
FIG. 6
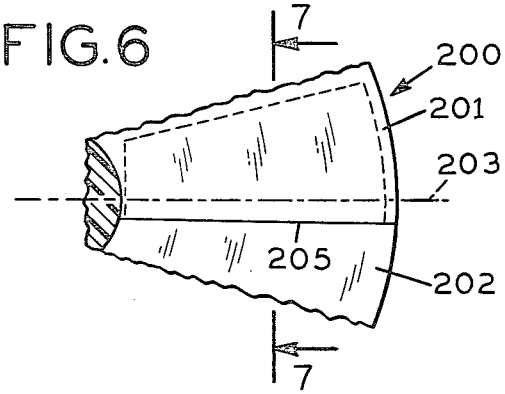
FIG. 7
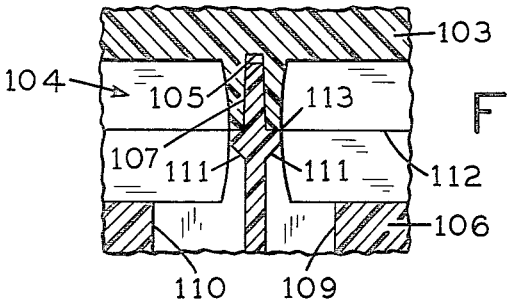
FIG. 5

ANTI-ROTATION ARRANGEMENT FOR NUTATING FLUID DEVICE

RELATED APPLICATIONS

This application is closely related in the subject matter to our following co-pending applications all directed to nutating action devices and improvements thereof: Ser. No. 827,625 filed Aug. 25, 1977; Ser. No. 848,806 filed Nov. 7, 1977; Ser. No. 848,807 filed Nov. 7, 1977; Ser. No. 888,136 filed Mar. 20, 1978; Ser. No. 888,137 filed Mar. 20, 1978.

BACKGROUND AND SUMMARY OF THE INVENTION

The present invention is related to a fluid driven, nutating action appliance and more particularly to a novel arrangement of various components of a nutating action appliance to provide an improved orbital output for a utilization device.

Generally, in a nutating action motor, a housing contains a sphere mounted for universal movement relative thereto, within certain angular limits. An annular plate or disc is integral with or carried by the sphere and an output device in the form of a shaft or rod extends from the sphere along the axis extending through the center thereof and at right angles to the annular plate. The annular plate is slotted at one side and the slot straddles a dividing wall which divides the housing. In the operation of the motor, a motive fluid (typically water) is supplied under pressure into the housing on one side of the dividing wall, travels in a circular path around the housing and leaves through an exit port on the opposite side of the dividing wall. Means are provided to maintain a predetermined angularity between the axis of the annular plate and the central axis of the housing. Thus, when water is admitted into the housing and travels around it to reach the discharge port, it pushes against the canted annular plate which thereby assumes progressively changing tilt angles. Consequently, the output shaft is moved in an orbital manner which may be mechanically transferred to a utilization device.

It is a primary objective of the present invention to provide a novel arrangement for the annular plate and the dividing wall whereby these two elements cooperate in a unique and advantageous manner with one another during the nutating action cycle of the motor to provide for a smoother, more efficient motion of the annular plate. In accordance with a significant feature of the present invention, the edges of a portion of the slot are placed in a close bearing relation with the dividing wall to prevent even minor rotational movement of the annular plate. The sides of the dividing wall are contoured to a curved surface in the region thereof which is in bearing relation to the edges of the slot. As the annular plate is moved through its nutating action cycle, the angular orientation of the plate, with respect to the dividing wall will vary from a right angle as when the annular plate is near the top or bottom of the dividing wall, to an acute angle, when the annular plate contacts the dividing wall in the mid-region thereof. Thus, the effective dimensions of the slot with respect to the dividing wall will be a function of the angular orientation of the annular plate. The surfaces of the dividing wall are arranged and configured whereby the curved surfaces thereof will form the plate to be wider at the top and bottom than at the mid-regions. In this manner, the effective thickness dimensions of the wall vary with the angular orientations of the annular plate, such that the edges of the slot are always in a close bearing relation to the dividing wall. Thus, for the entire nutating action cycle of the motor, the annular plate and dividing wall will be in a bearing relation to provide a smooth, efficient, rotation-free output for the motor.

In accordance with another specific feature of the invention, the curved dividing wall is of a two-part construction. Advantageously, the housing for the nutating action motor is formed by the assembly of an upper and lower housing part. Each of these parts may be conveniently molded from rigid plastic material and the nutating action motor chamber is formed by the assembly of two housing parts. Each part is formed to include an integral, concavely tapered extension extending from the inner surface thereof whereby when the two parts are assembled together, the two tapered extensions mate to form a curved dividing wall for the motor chamber. One of the integral tapered extensions may include a centrally disposed slit and the other a centrally disposed rib, whereby these two parts form an interfitting relation when the extensions mate to form the curved dividing wall. This arrangement provides for precise alignment of the respective wall-forming extensions while accommodating inexpensive molded construction of the housing.

In accordance with another feature of the invention, the line of intersection between the mating tapered extensions is so formed as to prevent its becoming aligned with the edges of the annular plate in the bearing area. This arrangement minimizes any physical disturbances which may be generated as the edges of the slot pass over the line of intersection during the nutating cycle of the motor.

For a better understanding of the above and other features and advantages of the invention, reference should be made to the following detailed description of preferred embodiments and to the accompanying drawings.

BRIEF DESCRIPTION OF THE DRAWINGS

FIG. 1 is a side cross-sectional view of a nutating action motor incorporating features of the present invention.

FIG. 2 is a top cross-sectional view of the nutating action motor as taken generally along line 2—2 of FIG. 1.

FIG. 3 is a partial cross-sectional view of the dividing wall and wobble plate of a nutating action motor arranged in accordance with the teachings of the present invention, as taken generally along line 3—3 of FIG. 2.

FIG. 4 is a partial side view of a modified embodiment of the dividing wall of the present invention.

FIG. 5 is a partial edge cross-sectional view of the modified dividing wall, as taken generally along line 5—5 of FIG. 4.

FIG. 6 is a partial side view of another embodiment of the dividing wall of the present invention.

FIG. 7 is a partial edge cross-sectional view of the modified dividing wall, as taken generally along line 7—7 of FIG. 6.

DETAILED DESCRIPTION OF PREFERRED EMBODIMENTS OF THE INVENTION

Referring now to the drawings, and initially to FIG. 1 thereof, a nutating action motor is designated by the reference numeral 10. The motor comprises an upper housing section 11 and a lower housing section 12. The housing sections 11, 12 advantageously are of a molded plastic construction and may be adhesively bonded along the central parting line 13 to form an enclosed chamber 14. The chamber 14 is, in general, a body of revolution, having side walls 15, of arcuate configuration whose center of curvature is at a central point 16 along the axis of revolution. The upper and lower walls 17, 18 of the chamber 14 are of a conical configuration and are so arranged that the opposed upper and lower chamber walls 17, 18 define an included angle of approximately 40° symmetrical about a plane passing through the central point 16 and perpendicular to the axis of revolution.

Each of the upper and lower housing walls 17, 18 is formed to terminate in a spherically contoured bearing seat 19, 20. The bearing seats 19, 20 are in an opposed relation and each is symmetrical about the central point 16. A spherical bearing 21 is mounted between the bearing seats 19, 20 for generally universal movement relative thereto. When the bearing 21 is supported in the seats 19, 20 and the housing parts 11, 12 are secured in their assembled relation, the spherical bearing 21 is freely movable in the seats 19, 20. However, a sufficiently close fit is provided between the spherical bearing 21 and the seats 19, 20 to reduce to a practical minimum leakage of driving fluid (typically water) around the bearing.

In accordance with known construction of nutating action motors, the spherical bearing 21 is provided with an annular disc or plate 22, which is aligned on a hemispherical plane passing through the central point 16. The disc 22 and bearing 21 form the wobble plate of the nutating action motor. The configuration of the conical housing walls 17, 18 is such, in relation to the thickness of the annular disc 22, that when the disc is tilted to the maximum extent permitted by the housing walls 18, 18, the upper face of the disc 22 is in tangential contact with the upper housing wall 17 and the lower face of the disc 22 is in tangential contact with the lower housing wall 18.

An output rod 23 is mounted in a perpendicular relation to the annular disc 22 and passes through the central point 16. The output rod 23 extends into a moving fit with an angularly disposed annular recess 24 formed in a bearing insert 25 mounted within the upper motor housing section 11. This arrangement will maintain the wobble plate of the nutating action motor in a canted position for all orientations of the annular disc 22. The bearing seat 20 of the lower housing seat includes a conical opening 32 whereby the output rod 23 extends outside the nutating action motor 10, to a driving connection with a utilization device (not shown).

A dividing wall 26 is arranged within the chamber 14 and extends from the upper chamber wall 17 to the lower chamber wall 18. The disc 22 includes a radially disposed slot 27 which straddles the dividing wall 26.

In the illustrated arrangement, a section of tubing 28 communicates with the chamber 14. The tubing 28 includes a central separating membrane 29, forming two channels 30, 31 and which is aligned with the dividing wall 26 of the chamber 14. A source of motive fluid (not shown) is connected to the tubing 28 whereby the driving fluid may be fed through one channel 30 into the chamber 14, on one side of the dividing wall 26. The motive fluid then circulates around the chamber 14 to the opposite side of the dividing wall and exits the chamber 14 through the other channel 31 of the tubing 28.

In the operation of the nutating action motor, the force of the water flowing through the chamber 14 pushes against the wobble plate causing it to assume progressively changing tilt angles with respect to the central axis of the chamber 14. Consequently, the output rod 23 will be moved through an orbital motion with the ends thereof circumscribing a circle. If desired, a utilization device may be secured directly to the output element, as set forth in our co-pending Application Ser. No. 827,625.

In a nutating motor of conventional construction, during each nutating cycle of a disc, the disc may undergo a small radial displacement by an amount equal to one-half the total maximum clearance between the edges of the slot and the dividing wall. In a conventional motor, the maximum clearance will occur when the disc is at the top or bottom of the divider. The radial displacement effect is due to the fact that the effective dimensions of the slot are smaller when the wobble plate is in an angular orientation with respect to the dividing wall (when centered between top and bottom of the wall) than when the wobble plate is perpendicular to the dividing wall (as at the top or bottom thereof). Therefore, the spacing of the slot must be wide enough to receive the dividing wall at the maximum angle of incline between the wobble plate and the dividing wall. The following equation will give the theoretical radial displacement at the top and bottom of the dividing plate:

Wobble: $(W-T)/2$ where $W$ = spacing of the slot $T$ = width of the divider

In a practical application, the divider width T may be 0.040" and the wobble plate may undergo a maximum angle of incline with respect to the dividing wall of 20°. To operate properly, the spacing of the slot must be made to be 0.046578" leaving a 0.003289" theoretical radial displacement during each nutating cycle of the annular plate. If the nutating action motor is made larger, with for example, a 0.125" wide dividing wall, the spacing of the slot must be increased to 0.1370330," permitting a theoretical radial displacement of 0.0060165." Thus, in a high output speed nutating action motor, the wobble plate may develop a radial displacement of sufficient magnitude to cause excessive vibration and other operating problems in the motor.

In accordance with one aspect of the invention, radial displacement of the plate 22 is prevented by an advantageous configuration and relationship of the dividing wall 26 and the radial slot 27 in the annular disc 22, whereby these two elements cooperate with one another during the entire nutating action cycle of the wobble plate to provide operation without significant radial displacement effect. Referring specifically to FIGS. 2 and 3, the slot 27 has two generally outwardly diverging sides 34 which are spaced from the dividing wall 26 and includes a portion 33 of reduced width which extends from approximately the mid-region of the annular disc 22 to the outer periphery thereof. The edges 35 of the portion 33 are in bearing relation with the dividing wall 26. As is clearly illustrated in FIG. 3, as the wobble plate moves through the various angular orientations within the chamber 14, the relative position of the annular plate 22 with respect to the dividing plate 26 will vary progressively from the dash-lined position illustrated at 22*a* to the angled position illustrated at 22 and finally to the dash-lined position illustrated at 22*b*. As discussed above, the effective dimensions of the spacing between the edges 35 of the portion 33 are smaller when the wobble plate is in an angular orientation, e.g. as depicted at 22, than when it is at either of the horizontally disposed positions indicated at 22*a* and 22*b*.

In accordance with the invention, the opposite surfaces of the dividing wall 26 are formed to a concavely curved surface whereby the dividing wall is wider at the top and botton than at the mid-region. The angle of curvature for the surfaces of the dividing wall 26 is such that the width of the wall is wider at the top by a predetermined amount. The width at any level is approximately equal to the center width divided by the cosine of the angle of the wobble plate at such level. In this manner, the progressively increasing effective spacing between the edges 35 will be taken up by the progressively widening width of the dividing wall 26. Therefore, the edges will always be in a close bearing contact with the dividing wall 26 for all angular positions of the wobble plate. The constant bearing contact between the annular plate 22 and dividing wall 26 eliminates radial displacement of the wobble plate to provide a smooth, vibration-free operation for the nutating action motor.

Referring now to FIGS. 4 and 5, there is illustrated an advantageous embodiment of the dividing wall 100 of a nutating action motor. The wall 100 comprises an upper section 101 and a lower section 102. The upper section 101 is integral with the upper housing section 103 and extends into the chamber 104 to the center line 112 thereof. The upper portion 101 is tapered from the top thereof to its extreme end and includes a centrally disposed transverse recess 105. The lower portion 102 is integral with the lower housing section 106 and extends into the interior of the chamber 104 to a mating relation with the upper portion 101. Similar to the upper portion 101, the lower portion 102 is also tapered. Moreover, the lower section 102 includes an integral extension 107 which is received within the recess 105 when the upper and lower portions 101, 102 are in a mating relation. The assembled portions 101, 102 form the dividing wall 100 with concavely curved outer surfaces which are wider at the top and bottom than at the mid-region thereof. The above-described two-part construction for the dividing wall 100, greatly simplifies the manufacturing process required to form a curved surface separating plate since each of the individual integral portions 101, 102 may be conveniently molded during the molding operation for the individual housing parts 103, 106, and are easily precisely aligned upon assembly.

In accordance with another specific aspect of the invention, the interfitting portions of the upper and lower portions 101, 102 are formed to provide a curved, parting line contour, whereby the line of intersection 113 between the portions 101, 102 forms a generally sinusoidal configuration within the bearing area 114 of the dividing wall 100 as clearly illustrated in FIG. 4. In this manner, as the edges of the slot of the annular wobble plate are displaced across the bearing arm 114 of the dividing wall 100, the sinusoidal configuration of the line of intersection 113 between the upper and lower portions 101, 102 will minimize any disturbance in the movement of the annular plate which may be caused by slight misalignments between the upper and lower portions 101, 102.

To advantage, the input and output ports 109, 110 for ingress and egress of the motive fluid, are formed within the lower housing section 106 and open at the bottom wall of the chamber 104 for communication with a supply tube (not shown). In accordance with another specific feature of the invention, cut-out portions 111 are formed on opposite sides of the dividing wall 100, spaced from the bearing region 114, and communicate with the input and output parts 109, 110, respectively. The cut-out portions 111 provide for a freer flow of the motive fluid into the chamber 104.

A modification of the two-part construction described above is illustrated in FIGS. 6 and 7. In this arrangement, the upper section 201 of the dividing wall 200 is slightly longer than the lower section 202 whereby the parting line of the sections is formed below the center line 203 of the chamber 204. Offsetting the line of intersection from the center line 203 tends to minimize any disturbance between the moving annular plate with a possible misalignment between the upper and lower portions 201, 202 because the wobble plate never aligns with the parting line. Several additional modifications to the parting line may also be made to minimize misalignment problems such as providing a sawtooth or step configuration to the parting line.

The present invention provides a highly effective means for transmitting orbital motion to a utilization device. The unique configuration of the dividing wall permits a close-bearing relation between the dividing wall and the annular disc for the entire operating cycle of the motor whereby the annular disc is prevented from moving through any significant radial displacement. The two-part construction for the dividing wall facilitates a straightforward manufacturing process by permitting the formation of each part of the dividing wall as an integral extension of the complementary motor housing section. This, of course, may be done during the molding of the various parts for the motor components. Assembly of the two housing parts will result in the mating of the two integral extensions to form the curved dividing wall. Moreover, the superior operation of the nutating action motor provided by the present invention permits a high speed output for the motor. Such operation will occur without vibration or excessive wear between the motor components. Thus, the present invention provides means for greatly improving and extending the utility of fluid-driven, nutating action motors.

It should be understood, that the various embodiments of the invention described above are representative only as certain changes therein may be made by one skilled in the art without departing from the teachings of the present invention. Accordingly, reference should be made to the following appended claims in determining the true scope of the invention.

We claim:

1. In a fluid driven, nutating action appliance (a) a motor housing consisting of two or more component parts (b) a wobble plate mounted in said motor housing for universal tilting movement and movable by a driving fluid through progressively changing tilt angles for a nutating action cycle, (c) means for ingress and egress of said driving fluid into the motor housing, and (d) a dividing wall arranged between said means for ingress and egress and extending from the top of the motor housing to the bottom thereof, (e) said wobble plate including a radial slot for reception of said dividing wall, (f) at least a portion of the edges of the slot being in a close bearing relation to said dividing wall, and the improvement comprising (g) said dividing wall comprising integral extensions of at least two of said motor housing components arranged in a mating relation (h) the dividing wall being arranged and configured whereby the areas thereof in a close bearing relation to the radial slot are contoured to a concaved surface, (i) whereby the close bearing relation between the radial slot and the dividing wall is maintained for the entire nutating action cycle of the appliance, thereby providing a smooth operation for the appliance, (j) said mating extensions defining a line of intersection therebetween, (k) said line of intersection being formed whereby at least certain portions of said line of intersection are offest from the radial slot of said wobble plate at any particular angular orientation of the wobble plate.

2. The improvement of claim 1, further characterized by (a) one of said sections of the dividing wall being longer in length than the other of said sections whereby the line of intersection formed by the mating relation of said sections is offset from the center line of the motor housing.

3. The appliance of claim 1, further characterized by (a) said means for ingress and egress of the driving fluid including an input port arranged on one side of said dividing wall and an outlet port arranged on the other side of said dividing wall, (b) said inlet and outlet ports communicating with the interior of the motor housing through the bottom wall of the motor housing, and (c) cut-out portions formed in each side of the dividing wall and communicating with the input and output ports respectively to facilitate fluid flow into and out of the motor housing.

4. The appliance of claim 3, further characterized by (a) said cut-out portions being offset from the area of the dividing wall in close bearing relation with said radial slot.

5. In a fluid driven, nutating action apparatus, including a motor housing having an upper housing wall and a lower housing wall and a wobble plate mounted in said motor housing for universal tilting movement within predetermined limits and movable by a driving fluid through progressively changing tilt angles for a nutating action cycle, and said wobble plate including an annular disc, (a) a dividing wall extending from said upper housing wall to said lower housing wall, (b) said annular disc including a radial slot which straddles said dividing wall, and (c) at least a portion of said slot being in a close bearing relation to said dividing wall, the improvement comprising (d) the sides of said dividing wall being formed to a concavely curved surface whereby said dividing wall is wider at the top and bottom portions thereof than at the mid-region thereof, (e) whereby the portions of said slot in bearing relation to said dividing wall will be in a close bearing relation for the entire nutating action cycle of the wobble plate, (f) said dividing wall comprising an upper section and a lower section in a mating relation, (g) said upper section being a concavely tapered integral extension of the upper motor housing wall, and (h) said lower section being a concavely tapered integral extension of the lower motor housing wall, (i) the configuration of each of said tapered extensions being such that when the upper and lower sections are in said mating relation the formed dividing wall includes sides each of which are in the form of a continuous concave curved surface from the top of the motor housing to the bottom thereof, (j) a line of intersection formed by the mating relation of said upper and lower sections of the dividing wall, (k) said line of intersection being formed to an other-than-straight line configuration in the areas of the dividing wall in close bearing relation to the radial slot of the annular plate.

6. The improvement of claim 5, further characterized by (a) said line of intersection being formed to a sinusoidal configuration in said bearing area of the dividing wall.

* * * * *